United States Patent [19]

Broyer et al.

[11] Patent Number: 4,610,262

[45] Date of Patent: Sep. 9, 1986

[54] SYSTEM FOR THE POWER-ASSISTED OPENING OF PARASOLS AND THE LIKE

[75] Inventors: Julien Broyer, Miribel; Bernard M. de Marancour, Caluire, both of France

[73] Assignee: S.R.P.M.:Societe de Realisation de Productions Metalliques, Miribel, France

[21] Appl. No.: 761,726

[22] Filed: Aug. 2, 1985

[30] Foreign Application Priority Data

Sep. 4, 1984 [FR] France ..... 84 13749

[51] Int. Cl.[4] ..... A45B 25/16

[52] U.S. Cl. ..... 135/23; 135/31

[58] Field of Search ..... 135/22, 23, 31

[56] References Cited

U.S. PATENT DOCUMENTS

| | | | |
|---|---|---|---|
| 256,774 | 4/1882 | Watson | 135/23 |
| 1,616,276 | 2/1927 | Orsik | 135/31 |

FOREIGN PATENT DOCUMENTS

| | | | |
|---|---|---|---|
| 473492 | 9/1914 | France | 135/22 |
| 1240610 | 7/1971 | United Kingdom | 135/22 |

*Primary Examiner*—Albert W. Davis, Jr.

*Attorney, Agent, or Firm*—Dowell & Dowell

[57] ABSTRACT

This invention relates to a system for the power-assisted opening of parasols, umbrellas and the like comprising a shaft of which one of the ends is provided with a cap on which ribs are articulated in star-like manner, wherein at least one compressed air jack is articulated by its cylinder on a ring fixed to the shaft, while the free end of its piston rod is pivotally mounted with respect to a tab of the rib lying in the same vertical plane as the jack. In folded position, the point of pivoting of the end of the piston rod with respect to the tab lies between the shaft and a line joining the axis of articulation of said jack on the ring and the point of articulation of the rib in question on the cap with a view to constituting a toggle joint maintaining the parasol closed.

3 Claims, 2 Drawing Figures

SYSTEM FOR THE POWER-ASSISTED OPENING OF PARASOLS AND THE LIKE

The present invention relates to large-dimensioned parasols comprising a system of ribs and stretchers foldable along a shaft for supporting a cover made of fabric or the like. The invention may of course be applied to frames or other like devices such as umbrellas, sunshades, etc . . . , although it is in the case of large-dimensioned parasols that its application appears to be of greatest interest.

It is difficult to open large-dimensioned parasols since the effort to be made to open the ribs is very considerable, with the result that such a manoeuvre cannot be made by some one who cannot develop great muscular force. Power-assisted opening systems have therefore been provided, employing reducing levers or rack systems moved by means of a crank. It will be readily understood that such power-assist systems are expensive and difficult to manipulate since they lie along the shaft, i.e. inside the cover of the parasol when the latter is closed.

It is an object of the improvements forming the subject matter of the present invention to produce a system for opening parasols whose cost price is relatively low, which is of small dimensions and whose operation is simple and reliable.

According to the invention, the known mechanical systems are replaced by at least one compressed air jack of which the arrangement with respect to the shaft and ribs allows said ribs to open automatically and be locked in closed position.

To this end, at least one compressed air jack or air spring known per se is provided, of which the cylinder is articulated on a ring fixed to the shaft, whilst the free end of its piston rod is associated with a tab fast with one of the ribs via means such that, when the parasol is closed, the point of fastening of the piston rod of the jack lies between the shaft and the fictitious line joining the articulation of the cylinder of said jack and the point of pivoting of the rib in question.

According to a preferred embodiment, an additional jack is provided, disposed diametrically opposite and of which the means for articulation on the corresponding rib are arranged so that this additional jack lies in position of unstable equilibrium when the parasol is closed.

The invention will be more readily understood on reading the following description with reference to the accompanying drawings, in which.

Figure 1:
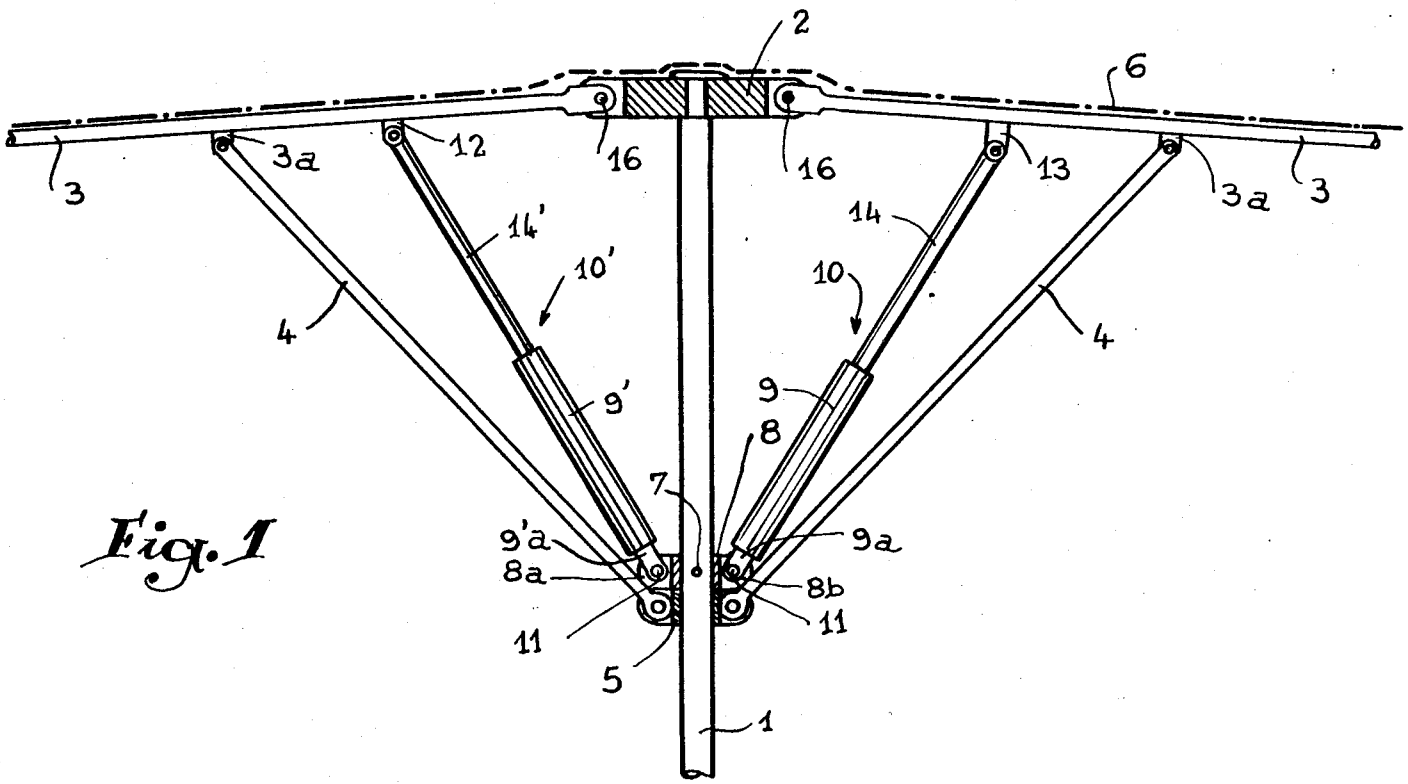
FIG. 1 is a partial view in section of a parasol provided with a system of power-assisted opening according to the invention, the parasol being shown in open position.

Referring now to the drawings, FIG. 1 shows a conventional parasol comprising a shaft 1 at one of the ends of which is mounted a cap 2 with respect to which are pivotally mounted a plurality of ribs 3 disposed in star-like manner from said cap. On a lug 3*a* fast with each rib 3 there is articulated the forked end of a stretcher 4 of which the other end is mounted to pivot with respect to a runner 5 which slides along the shaft 1 to bring all the ribs 3 from an extended position to a folded position or vice versa. Of course, the folding frame formed by the assembly of the ribs 3 is covered with a cover 6 made of fabric, plastics material or other appropriate material.

It is unnecessary to describe the above-mentioned arrangement in greater detail since it is conventional in the art.

In accordance with the invention, there is fixed on the shaft 1, above the upper position of the runner 5 in which the ribs are extended to stretch the cover 6, a ring 8, for example by means of a pin 7 passing through the latter and the shaft. This ring comprises two diametrically opposite fork joints 8*a*, 8*b* with each of which is associated the lower tongue 9*a*, 9′*a* of the cylinder 9, 9′ of a compressed air jack 10, 10′. Each tongue is articulated about a pin 11 passing through each of the fork joints 8*a*, 8*b*. The jacks used are sold on the market under the name compressed air jack; they are not connected to any source of supply and behave like a compression spring. A current application of such jacks is the servo-control of the closure or opening of safe doors or the engine compartment of automobile vehicles.

It will be observed that the fork joints 8*a*, 8*b* are oriented so that they lie in the vertical plane containing the shaft 1 and the two opposite ribs 3.

Each of the two opposite ribs of the frame of the parasol bears a tab 12, 13, respectively, on which is articulated the free end of the rod of piston 14, 14′ of each jack. It will be observed that the distance of tabs 12 and 13 to the shaft is identical, but that the length of the tab 13 is greater than that of tab 12 for reasons which will be explained hereinafter.

As the jacks 10, 10′ act in extension, i.e. their piston rod tends always to extend from their cylinder, the force developed by the jacks maintains the ribs of the parasol stable in open position. It is therefore unnecessary to provide a retractable stop for locking the runner 5 against the ring 8. However, such a system may well be used as a safety measure.

To close the parasol, it suffices to pull the runner 5 down the shaft 1 against the reaction of jacks 10, 10′. This downward pull of the runner may be effected by means of a handle or strap associated therewith. The effort is maximum at the beginning of the descending stroke of the runner and it decreases as closure takes place.

Figure 2:
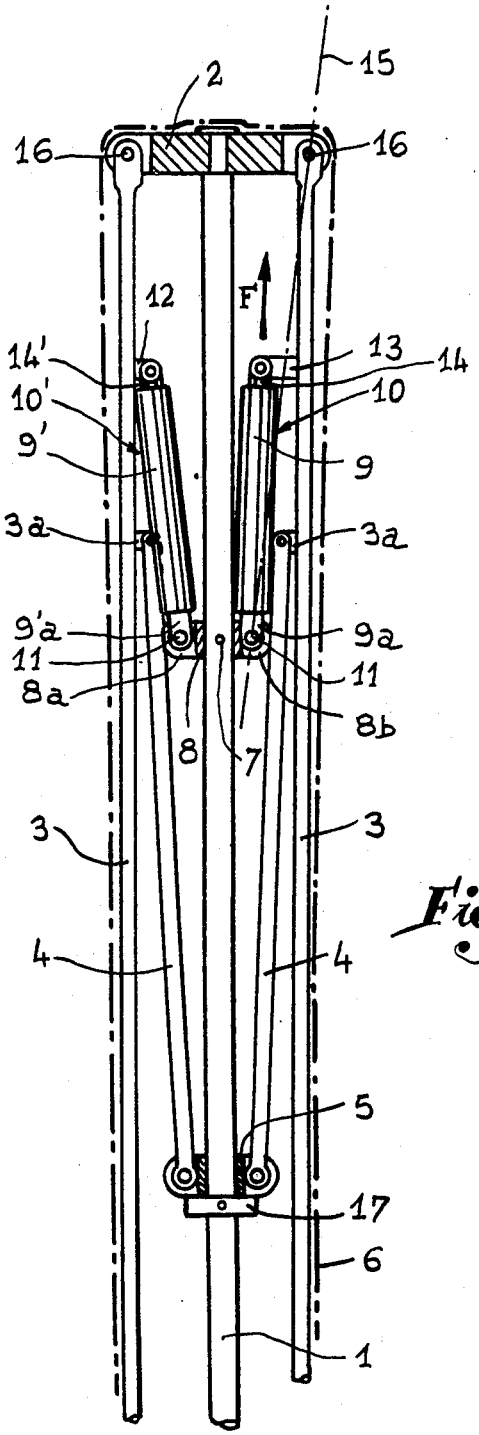
FIG. 2 shows the parasol according to the invention in closed position.

At the end of the downward movement of the runner 5, the two jacks are virtually completely contracted as illustrated in FIG. 2. In this Figure, it is observed that the point of articulation of the piston rod 14 of jack 10 with the lug 13 lies between the shaft 1 and a fictitious line referenced 15 which joins the point of articulation 16 of the rib bearing the tab 13 to the pin 11 on which the cylinder of said jack is articulated. As the effort developed by the jack is made in the direction of arrow F, i.e. in the direction of cap 2, the triangulation in question constitutes a force which tends to apply the rib in question against the shaft. Of course, pivoting of the rib 3 associated with the jack 10 ensures that of the other ribs as all the ribs are fast with the cap 2 and the runner 5. Similarly, locking thereof against the shaft provokes locking of the other ribs.

Regarding the second jack 10′, as its tab for articulation on the diametrically opposite rib of the frame is shorter than tab 13, its articulation on the piston rod 14′ of this jack lies on the line joining the pivot point 16 of the rib bearing the tab 12 to the axis of articulation 11 of the cylinder 9′ of the jack in question. In this way, when the parasol is folded, the jack 10′ associated with the tab 12 is in position of unstable equilibrium, with the result that it does not influence the maintenance in folded position of the different ribs.

The rib bearing tab 13 may be provided with a cord or other means for tying up all the ribs, this means being used for provoking opening. To that end, after the cord has been undone, it suffices, after the shaft has been placed in vertical position and its lower part fixed on an appropriate base, for the user to pull lightly on the cord in centrifugal manner to provoke displacement of the point of articulation of jack 10 on the tab 13 outside line 15, so that, from that moment, opening is automatic thanks to the action of the two jacks 10, 10'.

A system of power-assisted opening and closure has thus been produced for parasol or the like which is opened simply by acting on one rib provided with a control jack arranged so as to form a toggle joint with it and the shaft.

It may of course be possible to employ only the jack 10 forming toggle joint, but it is preferable, in order to balance opening, to provide a second, diametrically opposite jack 10'. It is obvious that, in the case of parasols of very large dimensions, several jacks 10' may be provided, of which one would be disposed diametrically opposite jack 10.

A bush 17 may be provided, constituting a lower stop for the runner 5, but the presence of this element is not indispensable, as the stop may be effected by contact of the cylinder of jack 10 against the shaft.

It must, moreover, be understood that the foregoing description has been given only by way of example and that it in no way limits the domain of the invention which would not be exceeded by replacing the details of execution described by any other equivalents.

What is claimed is:

1. A system for the power-assisted opening of parasols and the like comprising a shaft of which one of the ends is provided with a cap on which ribs are articulated in star-like manner, wherein it comprises at least one compressed air jack, of which the cylinder is articulated on a ring fixed to the shaft, whilst the free end of its piston rod is associated with a tab fastened to one of the ribs by means such that, when the parasol is closed, the point of fastening of the piston rod of the jack with respect to the tab lies between the shaft and the fictitious line joining the articulation of the rib in question on the cap of the parasol and the axis of articulation of the cylinder of said jack on the ring.

2. The power-assisted opening system of claim 1, wherein an additional jack is provided, disposed diametrically opposite with respect thereto, and of which the means for articulation on the corresponding rib are arranged so that this additional jack lies in position of unstable equilibrium when the parasol is closed.

3. The system of opening of claim 2, wherein the tab on which the piston rod of the jack is articulated is longer than the one with which the rod of the second jack is associated, said tabs being located at an equal distance from the cap.

* * * * *